US007703407B2

(12) United States Patent
Dunn

(10) Patent No.: US 7,703,407 B2
(45) Date of Patent: Apr. 27, 2010

(54) STABLE MARITIME PLATFORM

(75) Inventor: Michael J. Dunn, Federal Way, WA (US)

(73) Assignee: The Boeing Company, Chicago, IL (US)

( * ) Notice: Subject to any disclaimer, the term of this patent is extended or adjusted under 35 U.S.C. 154(b) by 2 days.

(21) Appl. No.: 11/944,922

(22) Filed: Nov. 26, 2007

(65) Prior Publication Data

US 2009/0133613 A1 May 28, 2009

(51) Int. Cl.
*B63B 35/50* (2006.01)
*B63B 35/44* (2006.01)

(52) U.S. Cl. ..... 114/261; 114/258

(58) Field of Classification Search ..... 114/256, 114/257, 312, 258, 264, 266, 267, 261; 441/1, 441/21

See application file for complete search history.

(56) References Cited

U.S. PATENT DOCUMENTS 3,273,526 A * 9/1966 Glosten ..... 114/265
3,327,668 A * 6/1967 Von Schultz ..... 114/265
3,339,511 A * 9/1967 Daniell ..... 114/264
3,413,946 A * 12/1968 Von Schultz ..... 114/264
3,575,005 A * 4/1971 Sumner ..... 405/196
3,778,854 A 12/1973 Chow
3,856,052 A * 12/1974 Feucht ..... 138/119
4,054,104 A * 10/1977 Haselton ..... 114/264
4,329,690 A * 5/1982 Parker ..... 343/709
4,556,341 A 12/1985 Ayers
4,557,390 A 12/1985 Mick
4,656,959 A * 4/1987 Moisdon ..... 114/56.1
4,665,857 A * 5/1987 Akerman et al. ..... 114/261
4,703,709 A * 11/1987 Behar et al. ..... 114/256
5,189,978 A * 3/1993 McAllister ..... 114/258
5,480,114 A 1/1996 Nakamura
6,263,824 B1 7/2001 Balint et al.
6,341,573 B1 * 1/2002 Buck ..... 114/261
6,341,665 B1 1/2002 Zhou et al.
7,040,247 B2 5/2006 Chouery

OTHER PUBLICATIONS

BoatDesign.net forums, retrieved Sep. 18, 2007 at http://forums.boatdesign.net/showthread.php?t=815, Jelsoft Enterprises, Ltd., 8 pgs.
"Floating Instrument Platform—FLIP", retrieved on Feb. 24, 2009 at http://www.mpl.ucsd.edu/resources/flip.intro.html, MPL UCSD Resources, 2 pgs.
Wikipedia, "Brent Spar", retrieved on Feb. 24, 2009 at http://en.wikipedia.org/wiki/Brent_Spar_oil_rig, 8 pgs.

* cited by examiner

*Primary Examiner*—Daniel V Venne
(74) *Attorney, Agent, or Firm*—Lee & Hayes, PLLC

(57) ABSTRACT

Systems and methods for a stable maritime helicopter platform are disclosed. In one embodiment, a ship that may be converted into a spar buoy includes a flipping mechanism to convert the ship to the spar buoy, a takeoff and landing platform for helicopters and other VTOL vehicles, and an actuation and balance system to deploy the platform.

20 Claims, 6 Drawing Sheets

STABLE MARITIME PLATFORM

FIELD OF THE INVENTION

The field of the present disclosure relates to a convertible stable platform deployed as a spar buoy configuration, for vertical take-off and landing (VTOL) vehicles, such as helicopters.

BACKGROUND OF THE INVENTION

In deploying vertical take-off and landing (VTOL) vehicles, such as helicopters and tilt-rotor aircraft, near land masses, large aircraft carriers with stable landing platforms may be used. The use of an aircraft carrier can be expensive. Floating landing platforms (e.g., converted oil drilling platforms) may also be used; however, such floating landing platforms can expensive to build and slow to deploy. A temporary structure erected near a land mass can be expensive and time consuming.

The following scenario is described in the context of a military operation; however, similar scenarios are applicable in nonmilitary applications, where deployment of such VTOL aircraft may also be employed (e.g., oil exploration). In a military scenario, battle operations call for light, rapidly deployable, maneuver forces supported by remote munitions. Such maneuver forces rely on intermediate staging bases (i.e., landing and take off platforms) for VTOL vehicles, in or near the theater of operations to support troops, logistics, and combat fire support. A deployable sea base represents maneuverable capability to rapidly provide offensive and defensive power, as well as assembling, equipping, supporting and sustaining scalable forcible entry operations without the need for land bases in the joint area of operations. As discussed above, the use of large aircraft carriers, temporary platforms, and other solutions have proven to be costly and sometimes time consuming. Therefore, there is a need to provide a cost effective, highly deployable solution to providing staging areas (i.e., platforms) for VTOL vehicles.

Although desirable results have been achieved using prior art systems and methods, novel systems and methods that mitigate the above-noted undesirable characteristics would have utility.

SUMMARY

The convertible ship and platform in accordance with the teachings of the present disclosure may advantageously provide a stable highly deployable platform for VTOL vehicles, such as helicopters.

In one embodiment, a ship that may be converted into a spar buoy includes a flipping mechanism to convert the ship to the spar buoy, a takeoff and landing platform for helicopters and other VTOL vehicles, and an actuation and balance system to deploy the platform.

In another embodiment, a sea going platform for VTOL vehicles includes a spar buoy attached to the platform, and a system to deploy the platform and VTOL vehicles on the platform. The platform further includes support resources for operation of the platform.

In another embodiment, a method includes deployment of a number of sea going platforms for VTOL vehicles. The method includes determining a number of platforms, placing the platforms in determined locations, deploying the platforms, and advising as to configuration and resources of particular platforms.

The features, functions, and advantages that have been above or will be discussed below can be achieved independently in various embodiments, or may be combined in yet other embodiments, further details of which can be seen with reference to the following description and drawings.

BRIEF DESCRIPTION OF THE DRAWINGS

Embodiments of systems and methods in accordance with the teachings of the present disclosure are described in detail below with reference to the following drawings.

DETAILED DESCRIPTION

The present disclosure teaches systems and methods for a stable maritime platform. Many specific details of certain embodiments of the invention are set forth in the following description and in FIGS. 1-6 to provide a thorough understanding of such embodiments. One skilled in the art will understand that the invention may have additional embodiments, or that the invention may be practiced without several of the details described in the following description.

Described is a ship capable of converting into a spar buoy configuration and deploying a VTOL vehicle (e.g., helicopter) landing and takeoff platform positioned significantly above the wave heights of heavy seas. The platform is stable in mild to severe sea states, and can be deployed in mid mid-ocean or littoral waters.

The ship includes a buoyancy mode, which is selectable between a conventional ship and spar buoy. The ship further includes the VTOL landing and takeoff platform. The ship has advantages over prior ships employing platforms providing similar features. An advantage is reduction in vessel displacement for a given platform area, resulting in the ability to convert the ship between different configurations. A primary benefit of a reduced displacement of this vessel concept is reduced construction, procurement, and operations cost. In particular, the ship may be converted to a conventional sea going ship for transport to theater of operations, and then be converted as a spar buoy for on-station duty. Rather than rely on large-displacement hulls for platform stability, the ship employs stable dynamics of a spar buoy. As a side benefit, since the ship is smaller than other ships serving similar purposes (e.g., aircraft carriers), a far smaller crew may be employed.

Figure 1:
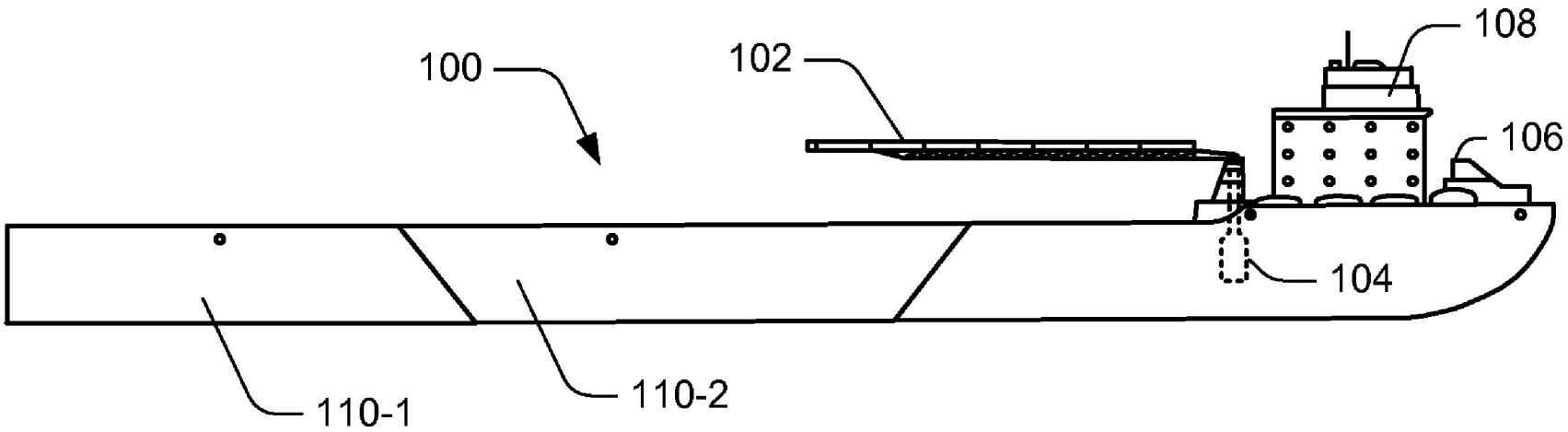
FIG. 1 is a side isometric view of a ship that implements a stable convertible platform for VTOL vehicles, in accordance with an embodiment.

FIG. 1 illustrates a ship 100 that employs a stable VTOL landing and takeoff platform 102. The ship 100 in is in conventional sea going mode. The platform 102 is erected or deployed with an associated actuation and balance system 104. The ship includes a control and command section 106, and crews' quarters 108 for support personnel. It is contemplated that control and control section 106 and crews' quarter can include communication, and navigation facilities, crew berthing, and medical facilities.

The ship 100 may further include power and propulsion equipment; ballast tanks; fuel tanks; buoyancy management and fueling systems, aspects of which are designed for normal operation in either a horizontal (sea going) or vertical orientation (spar buoy).

In this example, the ship 100 includes one or more ballast tanks 110-1 and 110-2 (although, two are shown as an example, it is contemplated that additional ballast tanks may be employed). The ballast tanks 110 are empty when the ship 100 is in a sea going configuration. When the ship is deployed as a spar buoy, the ballast tanks 100 may be filled with water. As the ballast tanks 100 fill with water, the ship becomes vertically oriented and the platform may be deployed. In this "flipping" operation, the ballast tanks 100 can be flooded by venting air. A "hard" tank can be implemented that could withstand full hydrostatic differential pressure during the flipping operation, in order to prevent "plunging" that would otherwise occur if the tanks were allowed to flood freely. Tank partitioning (e.g., multiple tanks) and the addition of ballast in the horizontal keel may also be employed to allow for safe flipping operation.

The exemplary implementation describes the use of ballast tanks to transition the ship 100 to the vertical orientation; however, it is contemplated that other techniques or "flipping" mechanism may be employed. For example, the use of shifting weights and balances may be employed.

As discussed below, an exemplary dimension for the platform 102 may be 100 feet in diameter. This may translate into a particular ship structure weight (size), where the ship structure weight scales as the area of the hull, decks, and bulkheads. In consideration of the weights of the platform 102, actuation and balance system 104, control and command section 106, crews' quarters 108, propulsion equipment, fueling equipment, communication equipment, etc., an estimated total weight (displacement) for the ship 100 would be 3,000 tons.

Figure 2:
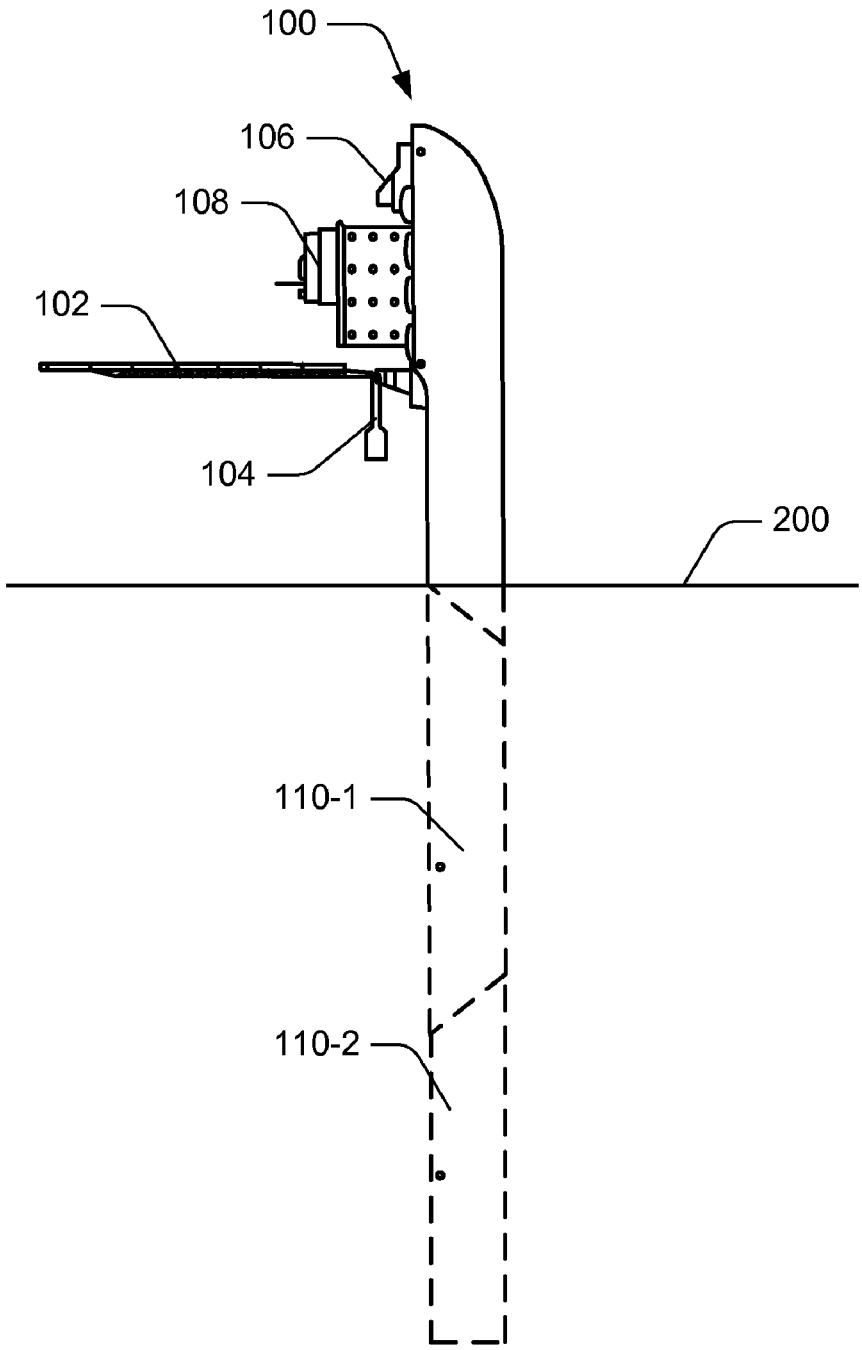
FIG. 2 is a side isometric view of a ship implementing a stable convertible platform in a spar buoy configuration, in accordance with an embodiment.

FIG. 2 illustrates vertical orientation. The ship 100 is deployed as a spar buoy, and the platform 102 is particularly configured to support takeoff and landing of VTOL vehicles. A flipping mechanism may be employed, and in this example ballast tanks 110 are filled with sea water, causing the ship 100 to "flip" into the vertical orientation.

The platform 102 may be erectable over a rotation angle of 90 degrees. The platform may be supported by a cantilever from the superstructure, and rotated into operational position as the hull of ship 100 progressively transitions from horizontal to vertical orientation. This may be particularly supported by the actuation and balance system 104. A fully loaded helicopter (VTOL vehicle) may gross as much as 25 tons. If such a heavily-loaded air vehicle were to settle on the platform 102, the ship 102 may be caused to tilt away from vertical reference. One way to counter this effect, is to implement counterweights that engage at a support axle or trunnion of the platform 102. Therefore as a helicopter or other air vehicle touches down on the platform 102, the imposition of weight on the platform would react through a geared lever to raise a counterweight to the other side of the vessel.

Waterline 200 indicates position of the ship in relation to the ocean or sea. In this vertical position, the platform 102 is less susceptible to effects from waves and sea movement. It is estimated that the platform may experience less than 1 meter vertical motion in the presence of waves that are 10 meters high.

The platform 102 may be sized to support particular VTOL vehicles. For example, 55-foot-diameter platform 102 has an area of 2,376 square feet. This would be marginally sufficient to support an AH-64D Apache Longbow helicopter having a rotor diameter of 48 feet and fuselage length of 58 feet. For larger vehicles, such as a CH-47F Chinook helicopter having a rotor diameter of 60 ft. and a shaft separation distance of 39-feet) or a V-22 Osprey helicopter with a rotor diameter of 38 feet and approximate wingspan of 47 feet, the diameter of platform 102 should be increased to approximately 100 feet, for an area of 7,854 square feet.

In sea going configuration or horizontal orientation, a large 100 foot diameter platform may not travel well. For example, ocean swells may roll up into the broadside overhang of the platform 102. Therefore, it may desirable for the platform 102 to collapse into a smaller beam dimension when the ship is in sea going configuration. This can be accomplished by segmenting the platform 102 onto separate elements, such that when erected, they are juxtaposed and structurally locked together.

Figure 3A:
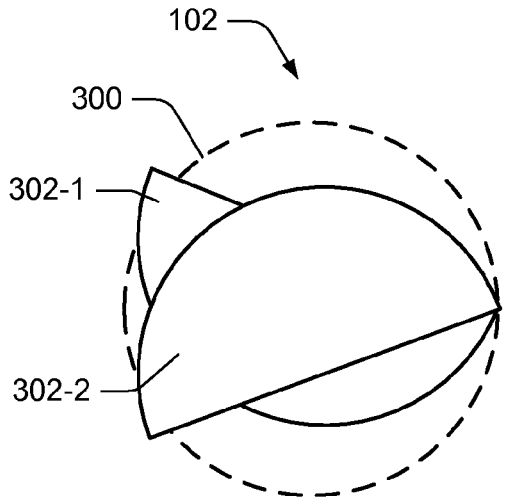
FIG. 3A is a top isometric view of a stable convertible platform in a semi-circle configuration, in accordance with an embodiment.

FIG. 3A illustrates one example of a segmented platform 102. The fully deployed platform 102 is in a circular shape 300. Circular shape is segmented into semi-circle shapes 302-1 and 302-2. When the ship 100 is in sea going or horizontal orientation, the platform 102 is broken up into semi-circle shapes 302.

Figure 3B:
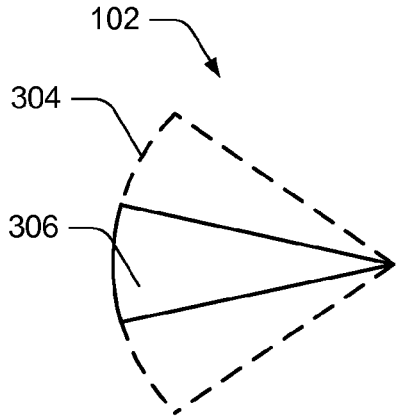
FIG. 3B is a top isometric view of a stable convertible platform in a pie shape configuration, in accordance with an embodiment.

FIG. 3B illustrates an alternate shape to break up segmented platform 102. In this example platform 102 is broken up into fan shape 304 that may be segmented into smaller pie shapes 306. It is contemplated that the number and type of segments (shapes) constitute a design optimization exercise. And it is contemplated that the outline of platform 102 can be circular, fan-shaped, polygonal, or any other profile that is suitable for the purpose.

Figure 4:
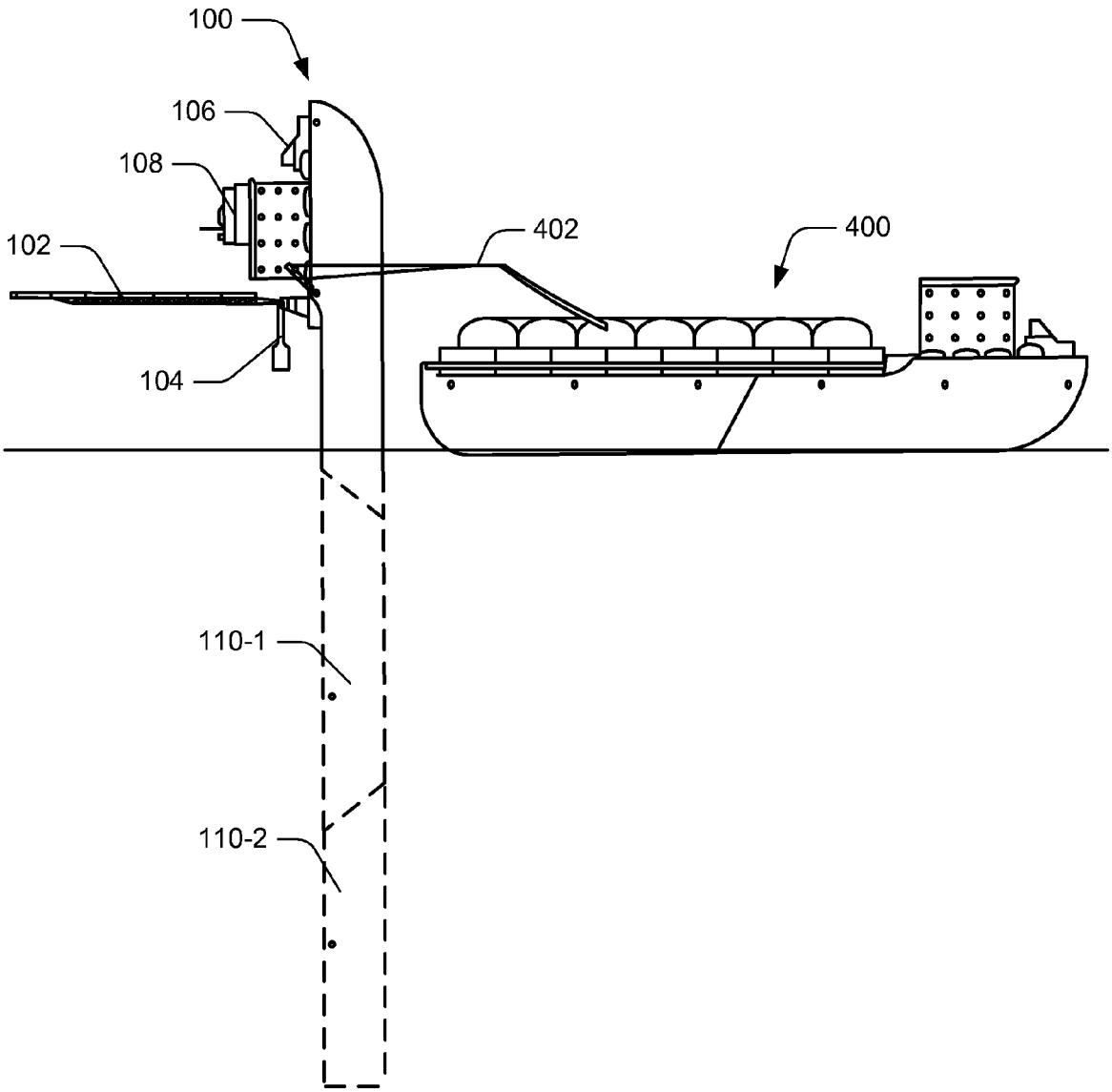
FIG. 4 is a side isometric view of a ship implementing a stable convertible platform in a refueling configuration, in accordance with an embodiment.

FIG. 4 illustrates refueling configuration. For prolonged deployments (i.e., missions), food and other provisions may be provided to the ship 100 and crew. Certain supplies, such as food and other provisions may be provided through vertical airlift. Water can be generated from on-board desalinization equipment. For utilities of the ship, such as those related to motive (i.e., propulsion and movement, and electrical power), petroleum based fuels may be needed. In addition, such fuels may be needed to support aviation assets (i.e., VTOL aircraft). Such fuel may also need to be transferred at sea on a continual basis.

Therefore, the ship 100 should be provided with the capability for at sea refueling. Fuel may be received by ship 100 from oilers and similar replenishment vessels, as represented by vessel 400, and provided to the ship 100 through line carrying booms 402, which can be rotated or extended into position.

Figure 5:
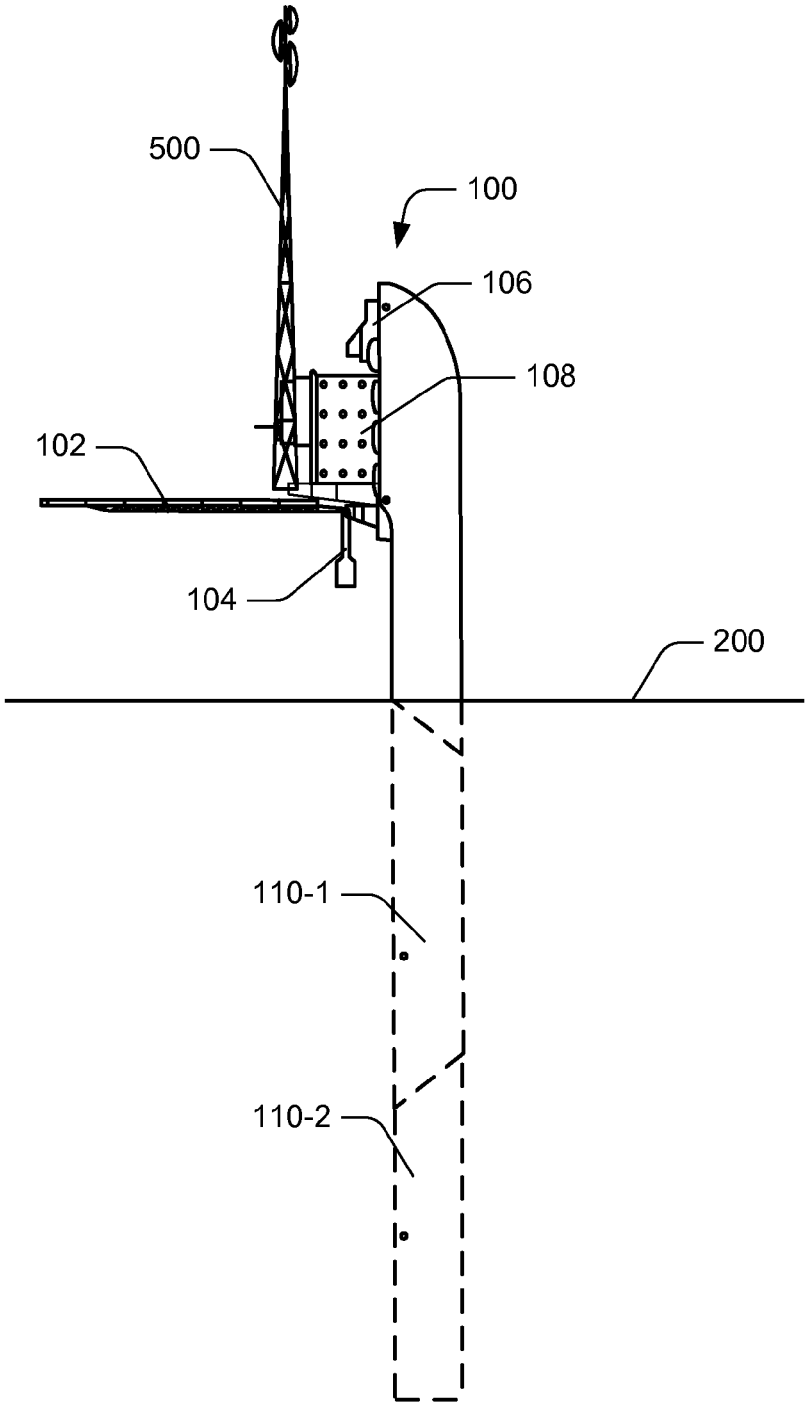
FIG. 5 is a side isometric view of a ship implementing a stable convertible platform with antennae, in accordance with an embodiment.

FIG. 5 illustrates a configuration with deployable communication systems and antennas 500. In support of VTOL aircraft, and operations or deployment in a littoral environment, there may be a need for intensive communication networking for deployed forces using ship 100. Therefore, deployable communication systems and antennas 500 may be included in ship 100 for such communication networking. A possible scenario is main ships in a deployed formation (aircraft carriers, assault carriers, etc.) may find their available communication channels overloaded. If such a circumstance arises, it may be beneficial for the main command-and-control vessels to "pipe" bundles of high-data-load communication over communication networks, such as Ku- and Ka-band microwave beams to nearby deployable ships such as ship 100 through communication systems and antennas 500. High-data-load communication bundles can be unbundled and retransmitted, for example, over additional X-band or C-band radio links provided by communication systems and antennas 500. Communication systems and antennas 500 can include an extensible radio antenna mast and suitable communications equipment.

Exemplary Methods

Figure 6:
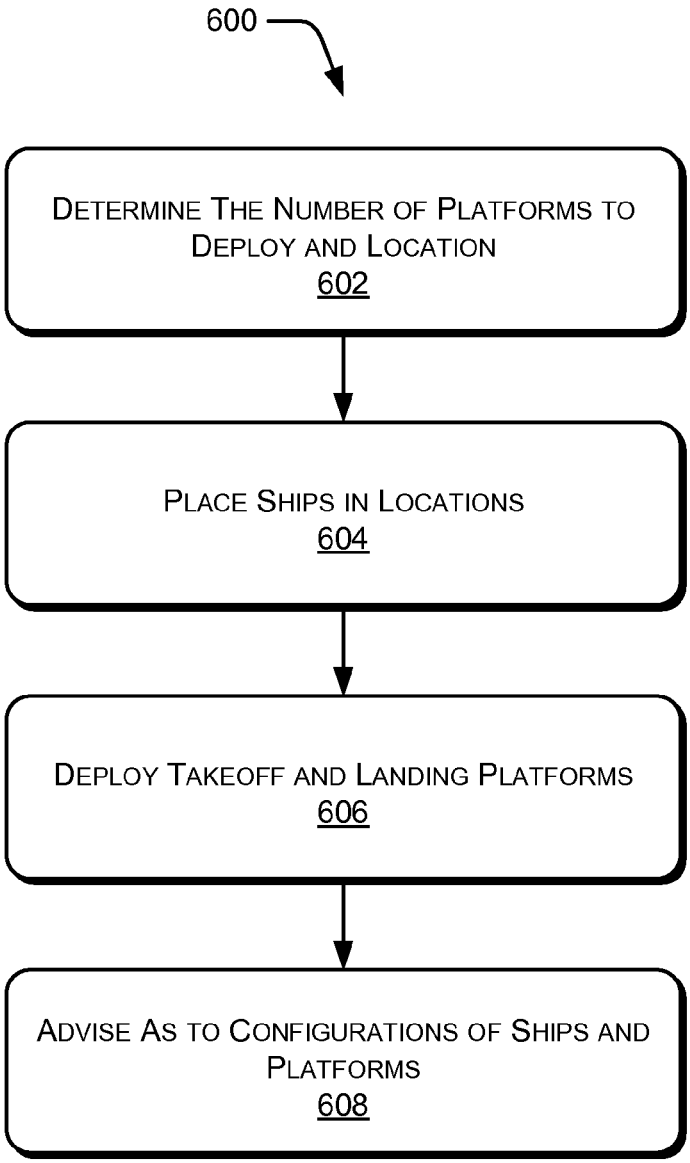
FIG. 6 is a flowchart illustrating implementation of multiple stable convertible platforms implemented as spar buoys, in accordance with an embodiment.

Exemplary scenarios for deploying convertible stable platform deployed as a spar buoy configuration, for vertical take-off and landing (VTOL) vehicles, are described with reference to FIGS. 1-5. FIG. 6 illustrates an exemplary method 600 for deployment of ships, such as ship 100. The order in which the method is described is not intended to be construed as a limitation, and any number of the described method blocks can be combined in any order to implement the method.

At block 602, a determination is performed as to the number of takeoff and landing platforms to support VTOL vehicles. In certain implementations, the platforms may be used for transoceanic fueling stops for overseas deployment of VTOL vehicles. The platforms are particularly deployable platforms on ships, such as ship 100. The determination includes locations of the platforms in a specific theatre of operation. Factors can include the type of operations such as military, search and rescue, observation, and research. The determination can also include the capabilities needed from the ships, including communications and refueling.

At block 604, a placement of the ships is performed. In particular, ships such as ship 100 are deployed. The ships are sent to their respective locations in a sea going or horizontal position. While in transit, the platforms of the ships may be collapsed into a more suitable size for sea going travel. In particular, the platforms may be collapsed into one of various compacted shapes as described above in reference to FIG. 3.

At block 606, a deployment is performed for the respective platforms. Deployment is performed after the ships have been placed in their respective locations. The deployment can include reconstructing a compacted platform. In other words, if the platform has been compacted, the platform may be reassembled into a circular shape once the ship is in place. Deployment can include transitioning of the ship(s) from conventional sea going or horizontal orientation to a spar buoy or vertical orientation. The transitioning can be implemented using a flipping mechanism, such as the use of ballast tanks 110 described above. Reassembling the platform can take place before or after transitioning orientation of the ship. Part of the deployment includes rotating the platform into operational position as described above. This may be performed using the actuation and balance system 104 described above.

At block 608, an advisement is provided as to configuration and resources available at the ships and platforms. The advisement may be provided to various locations, including base operations and individual VTOL vehicles. Resources can include, among various resources, the size of a platform at a ship that can support particular VTOL vehicles. Other resources can include refueling ability of the ship (i.e., can VTOL vehicles be fueled at the particular ship). Communications resources of the ship may also be provided. In particular, specific communications ability of the ship may be provided. Other example resources include size of crew or crew's quarters to accommodate a maximum number of crew.

CONCLUSION

While specific embodiments of the invention have been illustrated and described herein, as noted above, many changes can be made without departing from the spirit and scope of the invention. Accordingly, the scope of the invention should not be limited by the disclosure of the specific embodiments set forth above. Instead, the invention should be determined entirely by reference to the claims that follow.

What is claimed is:

1. A ship that is converted into a spar buoy comprising:

a flipping mechanism to convert the ship into the spar buoy by tilting the ship in its entirety with respect to a water surface so that at least a portion of the ship that is previously above the water surface is below the water surface;

a stable platform for supporting vertical take-off and landing (VTOL) vehicles, the stable platform having an end that is pivotally attached to the ship at a cantilever structure; and an actuation and balance system to pivot the platform away from the ship via the cantilever structure as the ship converts to a spar buoy.

2. The single hull ship of claim 1, wherein the flipping mechanism includes ballast tanks that are filled with sea water to cause the ship to flip into a vertical orientation.

3. The single hull ship of claim 2, wherein the ballast tanks comprise multiple and partitioned ballast tanks.

4. The single hull ship of claim 1, wherein the stable platform is segmented and collapsed for sea going travel.

5. The single hull ship of claim 1, wherein the actuation and balance system includes counterweights to counter weight of VTOL vehicles landing on the platform of the single hull spar buoy.

6. The ship of claim 1, further comprising crews' quarters for the support personnel.

7. The ship of claim 1, further comprising boom lines to support at sea refueling of the single hull ship.

8. The ship of claim 1, further comprising antennas to support communications received and sent by the single hull ship.

9. A stable sea going ship for deploying vertical take-off and landing (VTOL) vehicles comprising:

a landing platform to support landing of VTOL vehicles;

a spar buoy pivotally attached to an end of the landing platform via a cantilever structure, the spar buoy including a flipping mechanism to convert the spar buoy into a ship by tilting the spar buoy in its entirety with respect to a water surface;

an actuation and balance system to pivot the platform into the spar buoy via the cantilever structure as the spar buoy converts into the ship; and support resources for operation of the platform.

10. The stable sea going ship of claim 9, wherein the platform is segmented and collapsed into a more compact arrangement.

11. The stable sea going ship system of claim 10, wherein the platform is segmented into one of the following: semicircle shape or pie shape.

12. The stable sea going ship of claim 9, wherein the platform has a diameter of 55 to 100 feet.

13. The stable sea going ship of claim 9, wherein each of the single hull spar buoy and the single hull ship includes only one hull that contacts a water body.

14. The stable sea going ship of claim 9, wherein the actuation and balance system includes counterweights to counter weight of VTOL vehicles landing on the platform.

15. The stable sea going ship of claim 9, wherein the support resources include one or more of the following: refueling, communications, and crews' quarters.

16. A method of deployment of convertible stable platforms for vertical take-off and landing (VTOL) vehicles comprising:

determining a number of convertible stable platforms to support a particular operation, each of the platforms having an end that is pivotally attached to a corresponding ship at a corresponding cantilever structure;

placing the platforms in locations to support the particular operation by positioning each ship and tilting each ship in its entirety with respect to a water surface to convert each ship into a corresponding spar buoy; and deploying the platforms by pivoting each platform away from the corresponding ship via the corresponding cantilever structure as the corresponding ship converts into the corresponding spar buoy.

17. The method of claim 16, wherein the determining includes determining resources of the platforms and location of the platforms.

18. The method of claim 16, wherein the deploying further includes using counterweights on at least one spar buoy to compensate for the tilting of the at least one spar buoy due to weight of the VTOL vehicles that land on the platform attached to the at least one spar buoy.

19. The method of claim 16, further comprising advising as to configuration and resources available at each of the platforms.

20. The method of claim 19, wherein the advising includes providing information as to sizes of the platforms, and resources available at the platforms.

* * * * *